US006729903B1

(12) United States Patent
Clark

(10) Patent No.: US 6,729,903 B1
(45) Date of Patent: May 4, 2004

(54) QUICK CONNECT/DISCONNECT ELECTRICAL CONNECTOR HAVING AN EXTENDED INSULATING TAB

(75) Inventor: Douglas S. Clark, Carbondale, IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/309,061

(22) Filed: Dec. 4, 2002

(51) Int. Cl.[7] ..... H01R 13/40

(52) U.S. Cl. ..... 439/590; 439/937; 439/892; 439/893; 439/521

(58) Field of Search ..... 439/590, 937, 439/892, 893, 521, 281, 732, 278

(56) References Cited

U.S. PATENT DOCUMENTS

| | | | | |
|---|---|---|---|---|
| 2,206,471 A | | 7/1940 | Taylor | |
| 3,200,367 A | | 8/1965 | Blanchenot | |
| 3,550,856 A | * | 12/1970 | Wise | 439/730 |
| 3,634,817 A | * | 1/1972 | Wise | 439/730 |
| 3,820,059 A | | 6/1974 | Gibbons | |
| 3,989,346 A | | 11/1976 | Manning | |
| 4,054,354 A | * | 10/1977 | Unger | 439/724 |
| 4,066,327 A | * | 1/1978 | Soes | 439/825 |
| 4,108,524 A | * | 8/1978 | Seligmann | 439/284 |
| 4,149,768 A | * | 4/1979 | Wise | 439/730 |
| 4,214,361 A | * | 7/1980 | Coldren et al. | 29/863 |
| 4,772,231 A | | 9/1988 | Hayes | |
| 4,820,181 A | | 4/1989 | Kuzuno et al. | |
| 4,990,099 A | | 2/1991 | Marin et al. | |
| 5,442,138 A | | 8/1995 | Ochi | |
| 5,444,185 A | | 8/1995 | Tanaka | |

FOREIGN PATENT DOCUMENTS

JP 4-277475 * 10/1992

OTHER PUBLICATIONS

Suttin, *IBM Technical Disclosure Bulletin*, "Safety Plug", vol. 19, No. 6, Nov., 1976.

* cited by examiner

*Primary Examiner*—Tho D. Ta
(74) *Attorney, Agent, or Firm*—Diederiks & Whitelaw, PLC

(57) ABSTRACT

A quick connect/disconnect conducting receptacle constructed in accordance with the present invention includes a conducting receptacle surrounded by an insulated cover having a defined length and an extended tab portion projecting from an upper edge of the insulating cover. Specifically, the conducting receptacle includes a central plate, as well as first and second curved fixing rims extending from and terminating above the central plate. The fixing rims are provided to clampingly engage a respective mating tab portion inserted into the conducting receptacle to form an electrical joint. In accordance with one form of the present invention, the extended tab portion is adapted to extend over an exposed surface of a mating tab portion in order to protect both a service technician from inadvertent contact with exposed conductive surfaces as well as preventing damage caused by grounding is an associated electrical component.

16 Claims, 2 Drawing Sheets

QUICK CONNECT/DISCONNECT ELECTRICAL CONNECTOR HAVING AN EXTENDED INSULATING TAB

BACKGROUND OF THE INVENTION

1. Field of the Invention

The present invention pertains to the art of electrical connectors and, more particularly, to an insulated quick connect/disconnect electrical connector including an extended insulating tab portion provided to protect a mating connector component.

2. Discussion of the Prior Art

Electrical connectors, which are interconnected one to another to establish a disengageable electrical contact, are known. There actually exists a wide array of connectors for interconnecting conductors, conductors to components, and the like. Of the many examples, the most common are known as male and female connectors which themselves take on a wide variety of forms, e.g. quick connect/disconnect tabs and receptacles, bullet connectors, and common household receptacles and mating plugs.

It is also known to utilize insulating covers with certain types of electrical connectors, with the covers serving to isolate the connectors from human contact or contact with other electrically conductive devices. For instance, with tab and receptacle type connectors, it is known to provide an insulating cover which extends about the receptacle to protect one half of the connection. The insulating cover terminates at the end of the receptacle and therefore, when a tab connector is positioned in the receptacle, a portion of the tab connector is directly covered. However, with such an arrangement, a remaining portion of the tab connector will remain exposed. FIG. 1 illustrates a prior art electrical connection arrangement of this type wherein an electrical component 2 of an appliance is shown having arranged thereon first and second terminal tabs or blades 5 and 6. As shown, when an insulated receptacle connector 7 constructed in accordance with the prior art is secured to terminal blade 5, is a large portion 9 of blade 5 remains exposed.

The exposure of portion 9 can represent a potentially serious problem. For instance, electric component 2, or any other analogous component including one or more blades 5, 6, could be incorporated within an overall device which requires maintenance or other service work. Even if component 2 is not being tested, portion 9 will still be disadvantageously exposed for potential contact by technicians, tools, or the like. In cases where component 2 needs to be tested, component 2 may actually be mounted in a somewhat inaccessible location due to size constraints and/or arranged among a host of other electrical components. Under these circumstances, it may prove difficult to safely navigate through a maze of wires and connectors without inadvertently creating a short circuit by grounding an exposed electrical surface.

The prior art does present examples of electrical connector arrangements which, in some way, reduce exposure of electrical terminals. In accordance with one known arrangement, as disclosed in U.S. Pat. No. 3,989,346, an insulating portion provided about an electrical receptacle-type connector is extended partially beyond an entire terminal end of the connector. The insulating portion restricts probe access to the receptacle or female portion of the connector in accordance with UL standards. However, this arrangement has little consequence on the exposure of a mating electrical blade. In a second example, presented in IBM Technical Disclosure Bulletin Vol. 19, No. 6, a line-cord socket includes a overhanging skirt which hides a screw fastener securing a mating two-prong plug to an electrical appliance. In operation, as the overhanging skirt hides the screw fastener, the two-prong plug cannot be removed without first disconnecting the line-cord socket to disconnect the appliance from a power source. Obviously, this overall arrangement does not represent a quick connect/disconnect electrical connector.

Certainly, while presenting effective solutions to select problems, neither of the above examples provide a solution to the aforementioned drawbacks associated with exposed surfaces in quick connect/disconnect electrical connectors. Therefore, despite the wide array of electrical connectors contained in the prior art, there still exists a need to provide protection against the exposure of mating electrical components in order to prevent inadvertent contact with electrically connected portions of quick connect/disconnect electrical connectors.

SUMMARY OF THE INVENTION

The present invention is directed to a quick connect/disconnect electrical connector incorporating an insulated cover including an extended insulating tab portion. Specifically, the electrical connector includes a conducting receptacle having a central plate, and first and second curved fixing rims extending from and terminating at a position spaced from the central plate. The fixing rims are provided to clampingly engage a tab or blade portion of a mating electrical connector. The receptacle further includes a conducting ferrule, interconnected with and extending from an end portion of the central plate, which is adapted to receive an electrical conductor in the form of a wire.

In particular, the receptacle of the electrical connector is provided with an insulating cover having a conductor end portion extending about and surrounding the conducting ferrule, a main body portion surrounding an electrical terminal of the receptacle, and an insulating tab portion projecting from the main body portion beyond the electrical terminal. In accordance with one embodiment of the present invention, the insulating tab extends from an upper edge of the insulating cover a distance equal to a length in the order of about one-quarter to one-half the length of the entire receptacle. With this construction, as the receptacle is engaged with a respective blade connector, the insulating tab extends over the entire blade, thus avoiding the presence of any exposed blade portion.

In accordance with another aspect of the invention, the electrical connectors are constructed by forming a carrier strip constituted by a plurality of interconnected insulated covers. The insulated covers are interconnected through an intermediate portion or frangible link which serves as a bridge between adjacent insulating tab extensions. More specifically, each intermediate portion is interconnected to a pair of successive insulating tab extensions. At these interconnection locations, cut indicators are provided as a mechanism by which the insulated covers may be separated from the frangible links. In one preferred form of the invention, the cut indicators are constituted by an indentation traversing the intermediate portion. Still other forms of cut indictors are contemplated by the present invention, examples of which include a series of perforations running across the intermediate portion, an elongated notch located adjacent to each tab extension, and the like.

After formation of the carrier strip, a conducting receptacle is inserted into each respective insulated cover, thus forming an electrical connector. The completed connector can then be provided to a manufacturing line as is, or separated into individual connectors depending upon the instantaneous need of an end user. Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
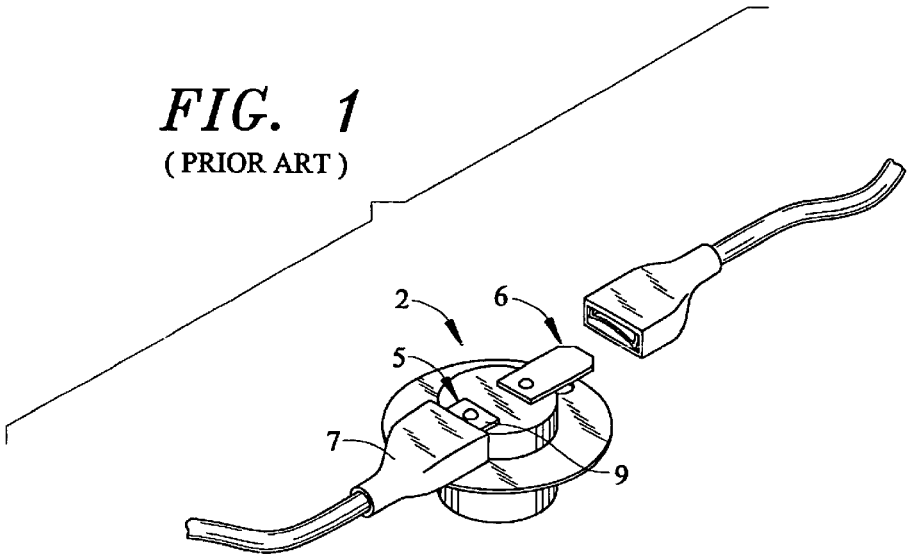
FIG. 1 ( PRIOR ART )
FIG. 1 is a partially exploded view of a prior art electrical device including terminal blades and insulated quick connect/disconnect receptacles.
Figure 2:
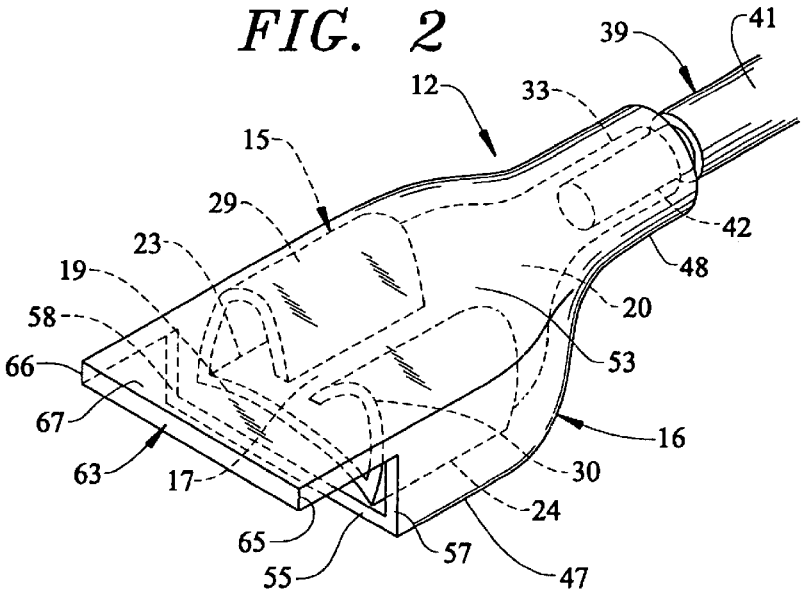
FIG. 2 is a perspective view depicting a quick connect/disconnect electrical connector in the form of a receptacle including an extended insulating tab constructed in accordance with the present invention.

With initial reference to FIG. 2, a quick connect/disconnect connector constructed in accordance with the present invention is generally indicated at 12. Specifically, in the embodiment shown, connector 12 includes a conducting receptacle 15 and an insulating cover or sleeve 16. As shown, conducting receptacle 15 includes a central plate 17 having a first or terminal end portion 19, a second or conducting end portion 20 and opposing side portions 23 and 24. In a manner known in the art, first and second fixing rims 29 and 30 respectively extend from opposing side portions 23 and 24, while terminating at a position spaced from central plate 17. Fixing rims 29 and 30 constitute lateral grips adapted to clampingly engage a mating tab or blade portion which is not depicted in this figure but will be discussed further below. In a manner also known in the art, a conducting ferrule 33 extends from conducting end portion 20. As shown, conducting ferrule 33 is adapted to be fixedly secured, such as by crimping, to an electrical conductor 39 which takes the form of a wire including an outer insulation layer 41 and an inner conducting core 42. In this manner, electrical conductor 39 serves as a pathway for electrical energy passing either to or from connector 12.

As further shown in FIG. 2, insulating cover 16 generally constitutes a sleeve that completely encapsulates conducting receptacle 15. Insulating cover 16 includes a main body portion 47 surrounding central plate 17 and fixing rims 29 and 30 of receptacle 15, and a conductor end portion 48 surrounding conducting ferrule 33. Main body portion 47 of insulating cover 16 includes an upper portion 53, a lower portion 55, and opposing side portions 57 and 58. As shown, main body portion 47 and conductor end portion 48 of insulating cover 16 have a combined length which is slightly longer than receptacle 15 such that insulating cover 16 extends about and covers all exposed portions of receptacle 15. With this construction, insulating cover 16 functions to isolate receptacle 15 from contact with humans or other electrical components so as to reduce the likelihood of injury or component damage in a manner known in the art.

In general, the structure described above with respect to connector 12 is known in the art and does not constitute part of the present invention. Therefore, this structure has only been described for the sake of completeness. Instead, the present invention is particularly directed to the incorporation of an extended tab portion 63 as part of insulating cover 16. As shown, extended tab portion 63 projects from upper portion 53 of main body portion 47. As shown, extended tab portion 63 includes opposing edge portions 65 and 66 connected together by a transverse central portion 67. In one form of the invention, extended tab portion 63 projects a distance in the range of about one-quarter to one-half the entire length of receptacle 15.

Figure 3:
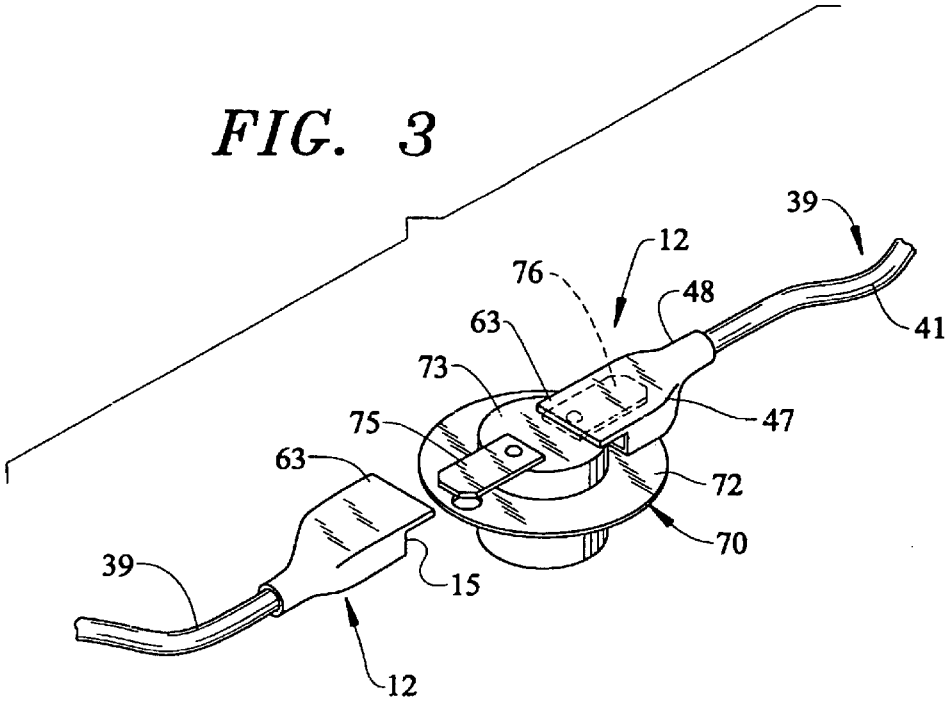
FIG. 3 is a perspective view of an electrical assembly employing terminal blades and insulated quick connect/disconnect receptacles constructed in accordance with the present invention.

Referring to FIG. 3 which depicts a preferred use of the invention, an exemplary electrical component is shown in the form of a bi-metallic thermostat 70. In a manner known in the art, thermostat 70 includes a body portion 72 having an upper surface 73 to which first and second terminal blades 75 and 76 are mounted. As shown, connector 12 is inserted onto terminal blade 76 such that first and second fixing rims 29 and 30 clamp terminal blade 76 to central plate 17, thereby establishing an electrical path to and/or from thermostat 70.

In accordance with a preferred embodiment of the present invention, as connector 12 is united with blade 76, extended tab portion 63 slides over the portion of blade 76 which is not received within receptacle 15. Once connector 12 is seated, extended tab portion 63 completely covers blade 76. In this manner, a service technician performing maintenance on an appliance containing thermostat 70 is protected from inadvertent contact with any electrical conductive surface. Moreover, as the service technician manipulates tools in proximity to thermostat 70, contact with conducting terminal blade 76, which could cause a ground, is prevented. As such, not only is the technician protected, but thermostat 70 is protected as well. At this point, it should be understood that, while reference has been made to utilizing the invention in connection with bi-metallic thermostat 70, the electrical component can take on a variety of forms and functions provided the component includes at least one terminal blade or tab element capable of being received in receptacle 15 of electrical connector 12.

Figure 4:
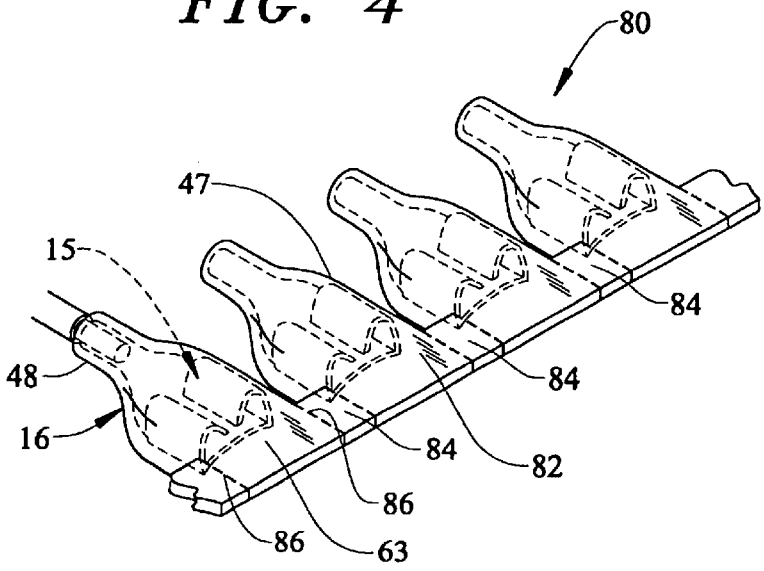
FIG. 4 is a perspective view of a carrier strip of insulating covers formed in accordance with the present invention.

Having described a preferred construction for connector 12, reference will now be made to FIG. 4 in describing a preferred method of manufacture in accordance with the invention. By means of a molding process, a plurality of insulating covers 16 are formed into a carrier strip which is generally indicated at 80. In accordance with a preferred embodiment, carrier strip 80 is defined by a plurality of insulating covers 16 which are interconnected through a respective plurality of intermediate portions or frangible links 84. In the most preferred form of the invention, each frangible link 84 acts as a bridge, joining a pair of successive insulating covers 16 through respective edge portions 65 and 66 of adjacent extended tab portions 63.

In a preferred arrangement, various lines of weakness 86, which can be constituted by cut lines, perforations, notches, or the like, are formed at the interconnection of each frangible link 84 and a respective extended tab portion 63. Once the plurality of insulated covers 16 are formed into carrier strip 80, a plurality of conducting receptacles 15 are inserted into respective insulated covers 16 thus forming a series of complete connectors 12. In accordance with one form of the invention, receptacles 15 are inserted after carrier strip 80 cools. However, in the most preferred form of the invention, receptacles 15 are inserted into insulating covers 16 while carrier strip 80 is still cooling from the molding process. In this manner, as each conducting ferrule 33 slides into a conductor end portion 48 of a respective insulating cover 16, an interference fit is formed which, upon cooling of the insulating cover 16, fixes receptacle 15 within insulated cover 16.

Although described with reference to a preferred embodiment of the invention, it should be readily understood that various changes and/or modifications can be made to the invention without departing from the spirit thereof. For instance, the insulating cover can be formed from a variety of processes, particularly depending upon the type of material used. In addition, the actual shape and length of the extended tab portion can vary dependent upon the type of application for which the electrical connector is intended. For instance, extended tab portion could also project from opposing side portions 57 and 58. In general, the invention is only intended to be limited by the scope of the following claims.

What is claimed is:

1. An electrical connector assembly comprising:

a conducting blade including first and second end portions;

a conducting receptacle including: a central plate having a first end, a second end and opposing side portions, and first and second curved fixing rims respectively extend from the opposing side portions and terminating above the central plate, said first and second curved fixing rims clampingly engaging the first end portion of the conducting blade; and a conducting ferrule extending from the second end of the central plate, said conducting ferrule being adapted to receive an electrical conductor; and an insulating cover including: a conductor end portion surrounding the conducting ferrule; a main body portion extending from the conductor end portion and surrounding the central plate and each of the first and second fixing rims; and an extended tab portion projecting from the main body portion beyond the central plate of the conducting receptacle and covering the second end portion of the conducting blade.

2. The electrical connector assembly according to claim 1, wherein the insulating cover constitutes a plastic sleeve.

3. The electrical connector assembly according to claim l, wherein the extended tab portion has a length which is at least equal to one-quarter of a length of the conducting receptacle.

4. The electrical connector assembly according to claim 3, wherein the length of the extended tab portion is approximately equal to half the length of the conducting receptacle.

5. The electrical connector assembly according to claim 1, further comprising:

a carrier strip constituted by a plurality of the insulated covers which are interconnected by interposed, frangible links.

6. The electrical connector assembly according to claim 5, further comprising:

a cut indicator extending across the carrier strip at an interconnection of the frangible link and a respective extended tab portion.

7. An electrical connector comprising:

a conducting receptacle including: a central plate having a first end, a second end and opposing side portions, and first and second curved fixing rims respectively extend from the opposing side portions and terminating above the central plate, said first and second curved fixing rims being adapted to clampingly engage a terminal blade; and a conducting ferrule extending from the second end of the central plate, said conducting ferrule being adapted to receive an electrical conductor; and an insulating cover including: a conductor end portion surrounding the conducting ferrule; a main body portion extending from the conductor end portion and surrounding the central plate and each of the first and second fixing rims; and an extended tab portion projecting from the main body portion beyond the central plate of the conducting receptacle wherein, when the electrical receptacle receives a terminal blade, a portion of the tenninal blade is adapted to extend within the main body portion of the insulating cover and another exposed portion of the terminal blade is adapted to be covered by the extended tab portion of the insulating cover.

8. The electrical connector according to claim 7, wherein the insulating cover constitutes a plastic sleeve.

9. The electrical connector according to claim 7, wherein the extended tab portion has a length which is at least equal to one-quarter of a length of the conducting receptacle.

10. The electrical connector according to claim 9, wherein the length of the extended tab portion is approximately equal to half the length of the conducting receptacle.

11. The electrical connector according to claim 7, further comprising: a carrier strip constituted by a plurality of the insulated covers which are interconnected by interposed, frangible links.

12. The electrical connector according to claim 11, further comprising: a cut indicator extending across the carrier strip at an interconnection of the frangible link and a respective extended tab portion.

13. A method of manufacturing an electrical connector comprising:

forming a carrier strip of a plurality of insulating covers, with each of said plurality of insulating covers including a conductor end portion, a main body portion, and an extended tab portion projecting from the main body portion said carrier strip being further formed with a plurality of frangible links, with each frangible link interconnecting adjacent ones of the insulating covers; and inserting a plurality of conducting receptacles into the plurality of insulating covers, with the conducting receptacles being encapsulated by the insulating covers and the extended tab portions projecting beyond the conducting receptacles.

14. The method of claim 13, further comprising:

providing a cut indicator at an interconnection between each frangible link and the adjacent ones of the insulating covers.

15. The method of claim 13, further comprising: integrally molding the carrier strip.

16. A method of insulating an electrical connection between a conducting blade and a conduction receptacle comprising:

encapsulating the conducting receptacle in an insulating cover;

electrically inter connecting a first end portion of the conducting blade and the conduction receptacle within the insulating cover such that the first end portion of the conducting blade is arranged within a main body portion of the insulating cover; and positioning an extended tab portion of the insulating cover, which projects from the main body portion, a second end portion of the conducting blade, wherein substantially the conducting blade is covered by the insulating cover.

* * * * *